US008192201B2

(12) United States Patent
Mandl

(10) Patent No.: US 8,192,201 B2
(45) Date of Patent: Jun. 5, 2012

(54) MIRROR FOR SHOWING A CHANGE OF SKIN APPEARANCE

(75) Inventor: Christian Peter Mandl, Egham (GB)

(73) Assignee: The Procter & Gamble Company, Cincinnati, OH (US)

( * ) Notice: Subject to any disclaimer, the term of this patent is extended or adjusted under 35 U.S.C. 154(b) by 527 days.

(21) Appl. No.: 11/508,456

(22) Filed: Aug. 23, 2006

(65) Prior Publication Data

US 2007/0050211 A1 Mar. 1, 2007

(30) Foreign Application Priority Data

Aug. 23, 2005 (EP) ..... 05018240

(51) Int. Cl.
*G09B 9/08* (2006.01)

(52) U.S. Cl. ..... 434/59; 434/371; 434/100; 434/99; 359/237; 359/240

(58) Field of Classification Search ..... 359/240, 359/237; 705/2; 434/371, 100, 99, 59; 472/58
See application file for complete search history.

(56) References Cited

U.S. PATENT DOCUMENTS

| | | | | |
|---|---|---|---|---|
| 6,824,387 | B2 * | 11/2004 | Sakai et al. | 434/94 |
| 7,104,800 | B2 * | 9/2006 | Ortiz-Valero et al. | 434/371 |
| 2006/0041451 | A1 * | 2/2006 | Hessel et al. | 705/2 |
| 2006/0179699 | A1 * | 8/2006 | Gemmell | 40/661 |

FOREIGN PATENT DOCUMENTS

GB 2000021 A 1/1979

* cited by examiner

*Primary Examiner* — Xuan Thai
*Assistant Examiner* — Banafsheh Hadizonooz
(74) *Attorney, Agent, or Firm* — Mark A. Charles; Megan C. Hymore

(57) ABSTRACT

A tinted mirror which has been treated to reflect a modified image of skin is used to allow a subject to consider a potential change of the appearance of his/her skin, which would follow from the application of a cosmetic product such as self-tanning product. The mirror may be tinted with a brown hue so as to reflect an image that corresponds to the change of coloration of skin after the application of a self-tanning product. The invention may be used in beauty parlor or supermarket aisle to help a subject visualize the potential effect of a self-tanning product on his/her skin.

11 Claims, 1 Drawing Sheet

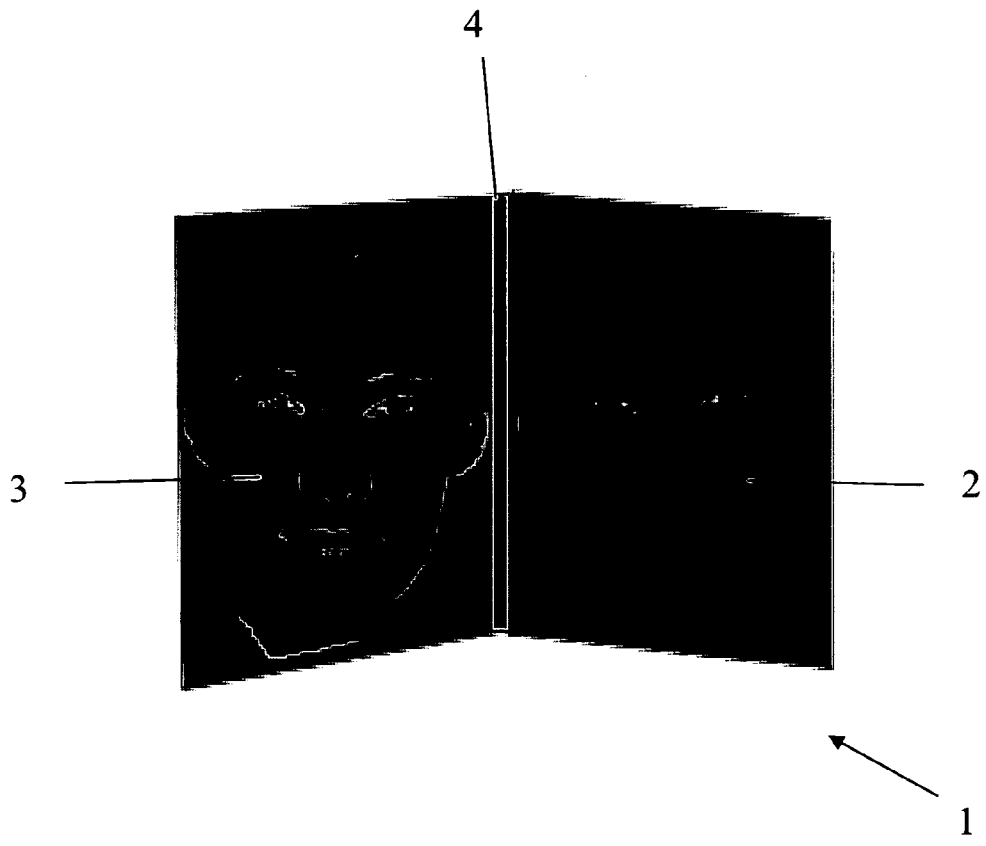
4
3
2
1

MIRROR FOR SHOWING A CHANGE OF SKIN APPEARANCE

FIELD OF THE INVENTION

The invention relates to a mirror which has been treated to reflect a modified image of skin corresponding to the potential effect of a skin-coloring product. The invention allows a male or female subject to consider the potential cosmetic change of the appearance of his/her skin which would result from the application of a cosmetic skin-coloring product such as a self-tanning product (or a tinted moisturizer, a powder, a foundation . . . ). The mirror may be tinted with a brown hue so as to reflect an image that corresponds to the change of coloration of skin after the application of a self-tanning product. The invention may for example be used in beauty parlor or supermarket aisle to help a subject visualize the potential effect of a self-tanning product on his/her skin.

BACKGROUND OF THE INVENTION

Self-tanning products (also commonly called self-tanners, sunless tanners or bronzers) have been commercially available for many years, and recent developments have made it possible to obtain an artificial coloration almost identical to what would be obtained by natural sun exposure. This is especially true for new products such as Olay® Radiance Reviver, which comprises relatively low level of self-tanning agents (usually a mixture of dehydroxyacetone (DHA) and erythrulose), and which are applied repeatedly for gradually building a tan.

However, inferior products have given a bad reputation to the category and many consumers still associate self-tanning products with an unnatural orange color. Contrary to hair dye products, the packaging of self-tanning products normally does not show a picture of the expected results. Rather, the packaging usually has an indication of the strength of the product (for example "light", "dark"). It can therefore be difficult for a prospective user to visualize in advance the potential appearance of his/her skin if he/she was to try the cosmetic product.

There is therefore a need for a system capable of displaying to a prospective user the potential change of appearance of his/her skin that would result from the application of a skin-coloring cosmetics, especially a self-tanning product.

In response to this need, the inventor has found that the image of an area of skin reflected by a tinted mirror can match surprisingly well the appearance of that area on which a skin-coloring product, especially a self-tanning product, is subsequently applied. Using a tinted mirror was found to be a cheap, quick and intuitive way to predict and display a change of skin coloration using a self-tanning product. It is believed that a treated mirror may also be used to reflect a potential change of skin appearance for other skin-coloring products, such as tinted moisturizers, colored powders, foundations, etc. . . .

U.S. Pat. No. 6,824,387, "Mirror for checking dyed hair color", discloses a mirror comprising a colored filter formed on part of the whole of the surface of the mirror. The colored filter is formed such that the color of the reflected image of hair from the colored filter is substantially the same as the dyed hair color for when the hair has been dyed with a particular hair dye. GB2,000,021A, "Method and Kit for Hair Colouring", discloses a method and kit for hair colouring using a coloured filter and a mirror. There is no indication in any of these documents that colored mirrors can be used for applications other than the dyeing of hair, in particular there is no mention of skin care products.

SUMMARY OF THE INVENTION

A first aspect of the present invention is directed to a method for displaying a potential change of appearance of a skin area following the application of a skin-coloring product, for example a self-tanning product, said method comprising the steps of:

i) providing a tinted mirror, ii) reflecting the skin area in said tinted mirror.

The tinted mirror is treated to reflect an image representative of the expected change of the skin area's appearance that would result from the application of the skin-coloring product. The surface of the mirror can for example be covered with a layer of transparent material having a (e.g. brown) tint to act as a filter.

The present invention is also directed to a device for displaying a potential change of appearance of a skin area following the application of a skin-coloring product, said device comprising:

a) a neutral mirror, which is with no distinctive tint, b) a tinted mirror, which reflects an image representative of the expected change of the skin area's appearance following the application of a skin-coloring product.

The neutral mirror and the tinted mirror may be connected by a hinge, and in this case are preferably foldable together. The mirrors may also be mounted to a display stand, preferably one adjacent to the other.

BRIEF DESCRIPTION OF THE DRAWINGS

FIG. 1 is a schematic view of a device according to the invention comprising two mirrors. The left-hand side mirror is neutral (it reflects an unmodified image of the subject), whereas the right-hand side mirror is tinted so as to reflect an image of the skin of the user that appears darker than it is.

DETAILED DESCRIPTION OF THE INVENTION

Herein, "comprising" means that other steps and other ingredients can be added. This term encompasses the terms "consisting of" and "consisting essentially of".

The term "skin-coloring product" as used herein refers to a skin cosmetic product whose effect is to modify the coloration of the skin. Non-limiting examples of skin-coloring products include self-tanning products, tinted moisturizers, powders and foundations.

The term "self-tanning product" as used herein refers to a cosmetic product whose purpose is to produce on the skin an appearance similar to a traditional suntan. The term "self-tanning product" encompasses semi-permanent self-tanning products and washable self-tanning products.

By "semi-permanent self-tanning products" we mean compositions comprising chemically active agents (self-tanning agents) such as dihydroxyacetone (DHA, a reducing sugar) that react within skin to produce an artificial coloration capable of darkening skin. These artificial colorations normally last for 5-7 days after the initial application.

By "washable self-tanning products" we mean compositions comprising mineral or synthetic pigments that do not chemically react on the skin and produce a tanning effect. Also called bronzers, these powders and moisturizers, are similar to make-up and can be easily rinsed off the skin.

The term "tinted mirror" as used herein refers to a mirror which has been treated to reflect an image with a distinct tint.

The term "neutral mirror" as used herein refers to a mirror that reflects an image with no distinct tint.

The present invention uses a tinted mirror which reflects an image of a skin area that appears more colored than the area really is. The mirror may for example be tinted so as to reflect an image of skin which appears more tanned than what the skin is.

The tint of the mirror can be obtained using any of the conventional techniques used by mirror manufacturers. For example, a film of a plastic transparent material in which pigments or dyes have been introduced can be glued or adhered to the surface of a conventional, "neutral" mirror.

Alternatively, tinted mirrors can be obtained by using a coloured/tinted glass and turning it into a mirror. An example how to obtain a mirror from glass is to coat it with a metal layer, preferably Aluminum or Silver. Further coatings can be applied to enhance the durability of the mirror. Typical examples of these coatings are a copper coating followed by one or several coating of a plastic material.

For self-tanning applications, the mirror is preferably tinted so as to reflect a brown image. Of course, the intensity of the tint can be adapted to the strength of different self-tanning products by varying the concentration of dye or pigments or the thickness of the filter. Other suitable tints that may be used in the context of self-tanning products may be described as red, pink, bronze or grey.

It was found that the characteristic of tinted mirrors can be defined by chromameter measurements using the CIE LCH colour sphere, where L represents Luminosity, C represents Chroma and H represents Hue. When the colour is measured with a chromameter (for example a Minolta CR-300, calibrated to CIE "C" illuminant) with the measurement area facing directly onto the mirror (measurement device including light source perpendicular to the mirror surface), in a dark room, it was found that the preferred tinted mirrors may have an L value not greater than 80, preferably 75-50, and a value for C greater than 4, more preferably greater 5. Hue values may assume any value if the C value is below 7. If the C value is greater or equal to 7, then a hue value in the range of 310° to 0° (can also be described as −50° to 0°) or 0° to 130° may be preferred.

The following values were obtained using the above-mentioned apparatus on two commercially sourced "brown" mirrors. Three measurements for each mirror and each parameter were made and the results averaged to give the values below:

| | L | C | H |
|---|---|---|---|
| | brown mirror 1 | | |
| average | 65.60 | 7.14 | 81.30 |
| | brown mirror 2 | | |
| average | 62.85 | 9.44 | 83.27 |

For comparison, here are the values obtained for a neutral (non-tinted) mirror under the same conditions:

| | normal mirror | | |
|---|---|---|---|
| | L | C | H |
| average | 82.62 | 3.32 | 152.57 |

Although the skin coloration eventually achieved on the skin of the user may be different from what was originally reflected by the tinted mirror (especially for user of semi-permanent self-tanning product due to the individuality of each person's skin chemistry), it is believed that the tinted mirror of the invention will generally give a good idea of the possible results to an unconvinced user. Furthermore, recent semi-permanent self-tanning products focus on a more gradual building of a tan using repeated applications of a self-tanning product comprising low level of self-tanning actives, so that the user may stop applying the self-tanning product once the desired tan is achieved.

It is envisaged that a tinted mirror could be used on its own or in combination with one or more other mirrors. For example, the device (1) shown on FIG. 1 comprises a tinted mirror (2) used in combination with a neutral (non-tinted) mirror (3). This allows the user to directly compare his/her current appearance in the neutral mirror (3) with a potential appearance obtainable after using a skin-coloring such as a self-tanning product and which is reflected in the tinted mirror (2). These two mirrors may be hingely attached to each other using hinge means (4), and may able to be folded over each other for easy of transportation and storage. The hinge means may be formed by a strong but flexible plastic material on which the mirrors are glued, or conventional mechanical hinges linking two rigid panels on which the mirrors are glued. Of course the setup may also be with a neutral mirror on the right-hand side and the tinted mirror on the left-hand side.

It is envisaged that the neutral and tinted mirrors may also be fixed to a display stand or a display vertically mounted, preferably in close proximity to each other so that the user can see his/her reflection in both mirrors from the same spot.

It is envisaged that several tinted mirrors according to the invention may also be used in combination. This may help a prospective user to select a skin-coloring product, for example a self-tanning product, among a choice of at least two different skin-coloring products, to obtain a particularly desired skin appearance. In this method, each skin-coloring product from the choice is first matched with a specific tinted mirror, so that the image of skin reflected by each tinted mirror corresponds to the result expected from the application of the matching skin-coloring product. Empirical results obtained by comparing the coloration results of the skin-coloring products on test subjects may be used to match each product with a particular tinted mirror.

The prospective user is then provided with the tinted mirrors, and is allowed to select from the reflected images the one corresponding to his/her desired skin appearance, for example a tan with a particular intensity. The skin-coloring product corresponding to the tinted mirror with the desired skin appearance is then indicated to the user.

It is envisaged that the methods and devices of the invention may be used directly by a prospective user of the skin-coloring product, as would be the case for example in a supermarket. In this case, written instructions will preferably be present to indicate to the user that his or her reflected image in the tinted mirror corresponds to his/her skin appearance after using a skin-coloring product. The written instructions may then associate the image reflected and the tinted mirror with a specific product, or alternatively only mention that the image reflected is obtainable using a certain category of skin-coloring product, for example a self-tanning product. Alternatively the mirror of the invention may be used by a trained attendant, for example in a department store or in beauty salons, to show to customers the potential effect of a skin-coloring product.

The invention may also be useful for promoting sales of a skin coloring product (preferably a self-tanning composition) by providing to the consumers a tinted mirror that reflects an image of skin corresponding to the result expected from the application of the skin coloring product.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for displaying a potential change of appearance of a skin area that would follow the application of a skin-coloring product comprising a self-tanning product, said method comprising:

i) providing a mirror device comprising a neutral mirror and a tinted mirror, wherein said neutral mirror comprises no distinct tint and said tinted mirror comprises a color tint that matches to the color of the skin-coloring product, and wherein said tinted mirror comprises a Luminosity of about 80 or less and a Chroma of about 5 or greater; and ii) reflecting an unmodified image of the skin area in said neutral mirror and the potential change of appearance of the skin area in said tinted mirror to enable a direct comparison between the unmodified image of the skin area and the potential change of appearance of the skin area.

2. The method according to claim 1, wherein the skin area is human facial skin.

3. The method according to claim 1, wherein said tinted mirror comprises a Hue of about 310° to about 0° or about 0° to about 130°.

4. A method for helping a prospective user to select a skin-coloring product among a choice of at least two different skin-coloring products, wherein the at least two different skin-coloring product comprises a self-tanning product, said method comprising:

matching each skin-coloring product with a specific tinted mirror, wherein the image of skin reflected by each tinted mirror corresponds to the result expected from the application of the matching skin-coloring product, and wherein said specific tinted mirror comprises a Luminosity of about 80 or less and a Chroma of about 5 or greater;

providing the user with the tinted mirrors to enable the user to select from the reflected images of the one corresponding to the user's desired skin appearance; and indicating to the user the skin-coloring product corresponding to the tinted mirror which reflects the desired skin appearance.

5. The method according to claim 4, wherein said specified tinted mirror comprises a Hue of about 310° to about 0° or about 0° to about 130°.

6. A device for displaying a potential change of an appearance of skin following the application of a skin-coloring product comprising a self-tanning product, and a tinted mirror comprising a color tint comprising a Luminosity of about 80 or less and a Chroma of about 5 or greater, wherein said color tint is configured to match the color of the skin-coloring product, and wherein said color tint is further configured to reflect an image representative of the expected change of the appearance of the skin following the application of the skin-coloring product.

7. A device according to claim 6 wherein said neutral mirror and said tinted mirror are connected by a hinge.

8. The device according to claim 7, wherein said neutral mirror and said tinted mirror can be folded together.

9. The device according to claim 6, wherein said neutral mirror and said tinted mirror are in a fixed position.

10. The device according to claim 9, wherein said neutral mirror and said tinted mirror are in close proximity such that the reflection of the user is visible to the user simultaneously in both mirrors.

11. The device according to claim 6, wherein said tinted mirror comprises a Hue of about 310° to about 0° or about 0° to about 130°.

* * * * *